United States Patent [19]

Dudley

[11] 4,441,995

[45] Apr. 10, 1984

[54] CHUNK SEPARATOR AND PROCESS OF SEPARATION FOR MACHINE TOOL SCRAP

[75] Inventor: Russell D. Dudley, Kalamazoo, Mich.

[73] Assignee: Reclamet, Inc., Kalamazoo, Mich.

[21] Appl. No.: 494,006

[22] Filed: May 12, 1983

[51] Int. Cl.[3] ..... B07B 4/02

[52] U.S. Cl. ..... 209/137; 209/153

[58] Field of Search ..... 209/136, 137, 146, 149, 209/153, 26, 27, 28, 135, 154, 134, 138

[56] References Cited

U.S. PATENT DOCUMENTS

| | | | |
|---|---|---|---|
| 150,879 | 5/1874 | Morse | 209/153 |
| 2,267,326 | 12/1941 | Eissmann | 209/136 |
| 3,360,125 | 2/1965 | Horsey | 209/153 |
| 3,655,043 | 4/1972 | Wochnowski et al. | 209/138 |
| 3,850,814 | 11/1974 | Dudley | 210/298 |
| 4,137,176 | 1/1979 | Dudley et al. | 210/375 |
| 4,310,417 | 1/1982 | Dudley et al. | 210/375 |
| 4,382,858 | 5/1983 | Dudley | 209/136 |

*Primary Examiner*—Tim R. Miles
*Assistant Examiner*—James McGowan
*Attorney, Agent, or Firm*—Price, Heneveld

[57] ABSTRACT

In the mechanism for supplying waste metal cuttings from machine operations to a centrifuge having air suction means for separation and recovery of the cutting oils, a driven paddle-wheel type feed gate is provided in an inclined, gravity operated feed conduit for both maintaining a generally uniform rate of feed to the centrifuge and for serving as a barrier against the entry of air through the infeed end of the conduit. An air aspiration port is provided adjacent to and on the centrifuge side of the paddle wheel through which large metal chunks are discharged by gravity while smaller cuttings are entrained by the incoming air stream and transported past the port to the centrifuge. The bottom of the conduit at the feed gate is movably mounted to permit the passage of large, chunky material and means are provided to assure discharge of long pieces of material.

18 Claims, 12 Drawing Figures

CHUNK SEPARATOR AND PROCESS OF SEPARATION FOR MACHINE TOOL SCRAP

BACKGROUND OF THE INVENTION

In machine tool operations it is economically advantageous to recover cutting oil which is mixed with metal chips, turnings and large chunks of metal and the like generated by these operations. Means for separating the metal chips from oils are well known in the machine tool operations industry. Centrifuge separators are typically used. See, for example, U.S. Pat. Nos. 4,310,417, 4,137,176 and 3,850,814.

A well recognized problem with centrifuge separators is that they are easily and quickly damaged by the large chunks of metal, for instance, scrap parts and bar ends, which often are included in a stream of metal chips from such operations. Large pieces of metal will severely damage centrifuge rotors. In the past, this possibility required either that the mixture of metal chips, turnings, chunks and cutting oils be visually inspected before being fed into the centrifuge, or that frequent shutdowns and repairs to the centrifuge be tolerated. Either alternative increases the cost of operating such a system.

Several systems have been devised to separate the damaging large chunks of metal from the stream of oily metal chips before the stream is introduced into the centrifuge. These systems include the use of a means of air classification of the material in a metal chip stream prior to crushing. These earlier systems are very complicated and expensive which has discouraged their use.

U.S. Pat. No. 4,310,417 discloses a chute for feeding chips into a centrifuge or other separating equipment where an opening is provided on the bottom of said chute through which large pieces of metal can drop before such pieces are introduced into the centrifuge. In the chute of U.S. Pat. No. 4,310,417, small chips are prevented from falling through the opening by a strong current of air drawn through the opening by an appropriately equipped centrifuge or by another blower-like device attached to the downstream end of the chute. A pivotal gate in the chute upstream of the opening provides a partial restriction against air being drawn into the chute upstream of the opening while periodically permitting metal chips and metal chunks to be introduced into the chute separator.

While the invention of U.S. Pat. No. 4,310,417 was a significant improvement over prior separator systems, it was not entirely reliable as a chunk separator and was subject to surging or pulsing due to non-uniform feed rates to the classifier.

When the movement of the chips is by gravity, the rate of flow can become irregular resulting in a pulse type of flow with chips moving through the chute in large masses. Under such circumstances some large pieces of metal can "wash over" the opening and be fed into the centrifuge. In addition, when large amounts of metal chips are fed through the pivotal gate, the gate is opened sufficiently to allow significant quantities of air into the conduit, causing the air velocity through the opening in the bottom of the chute to decrease. This results in small metal chips falling through said opening.

Even when the device of U.S. Pat. No. 4,310,417 is fed by appropriate means to prevent the wash over described above, the separation is only partial and not efficient. A significant fraction of the small chips falls through the opening because of problems created when the pivotal gate opens i.e. the air velocity of the air entering through the chunk discharge opening decreases temporarily, creating a pulsing effect.

SUMMARY OF THE INVENTION

The present invention comprises a conduit with an opening in the bottom wall of the conduit intermediate the ends of the conduit. A paddle wheel type rotary metering element is provided between the opening and the intake end of the conduit. The paddle wheel regulates the flow of metal chips, chunks and the like into the chute. It also provides a damper controlling the entry of air and makes the air flow entering at this end substantially uniform. Attached to the conduit, typically at the outlet end, is means for generating air flow demand, frequently a centrifuge. The air is drawn through the opening, and, as the metal chips are fed into the conduit by the paddle wheel gate, the small metal chips are entrained in the air stream flowing through the opening and are carried down the chute into the centrifuge. By contrast, large chunks of metal fall through the opening for they are too heavy to be entrained in the air current. To protect the paddle wheel metering element and to accommodate extremely large chunks of metal a hinged segment of the bottom wall of said conduit is provided underneath the paddle wheel and resiliently biased into closed position. This segment extends from the intake end of the conduit to the opening in the bottom wall of the conduit and is hinged at the intake end. A modification of the invention combines a helix with the paddle wheel for separating long pieces of material.

DESCRIPTION OF THE PREFERRED EMBODIMENT

Figure 1:
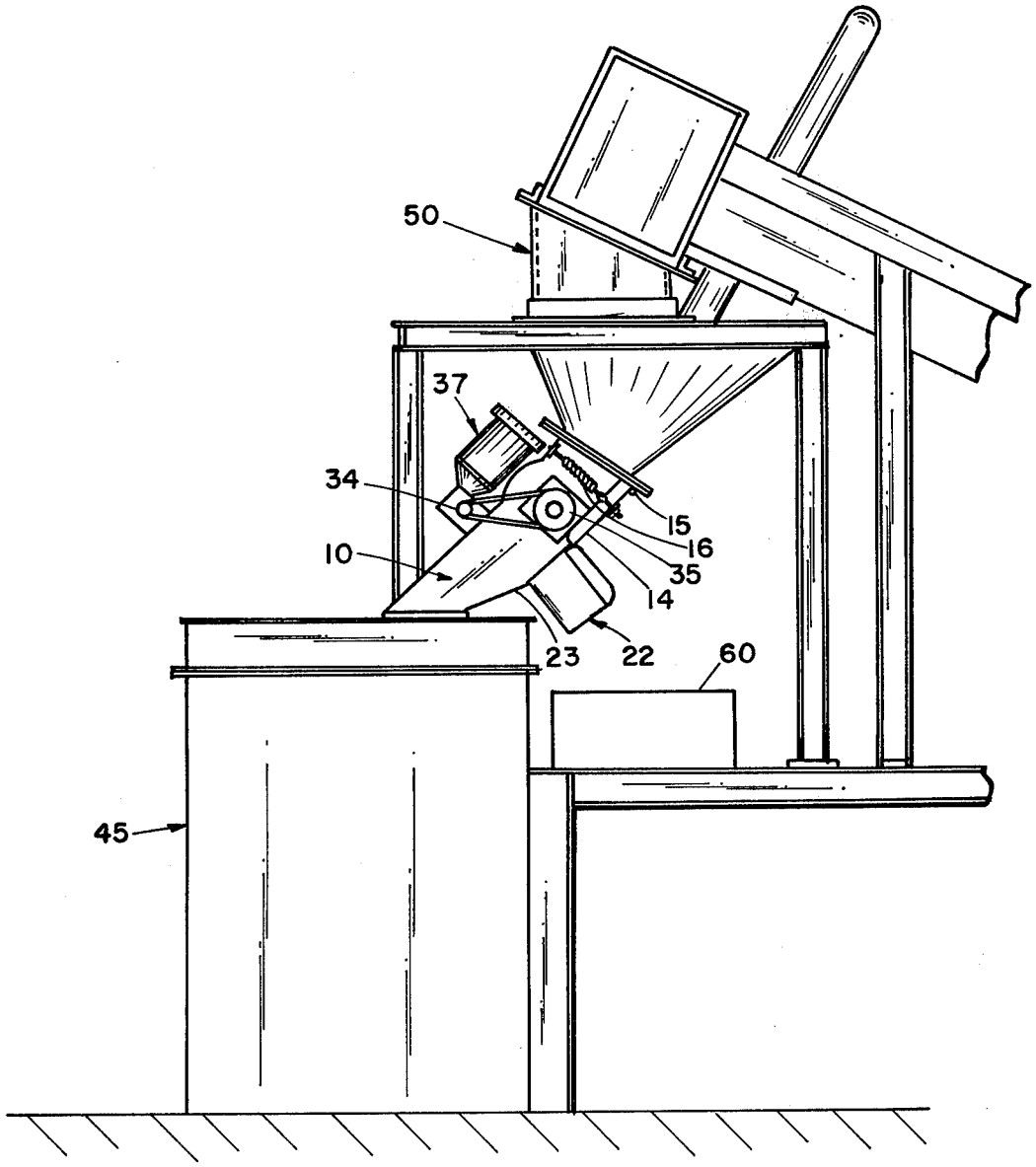
FIG. 1 is a side elevation of the invention as used in conjunction with the centrifuge connected to the outlet end of the separator; means for feeding the separator are also illustrated.

Referring to FIG. 1, conduit 10 is connected at its intake end to feed means 50 which can be either a gravity or a mechanical feeding device. The outlet end 13 of conduit 10 is attached to and discharges into a centrifuge 45 which is appropriately designed to create a suction through opening 11 in said conduit 10. Centrifuges of such design are well known in the prior art; see, for example, U.S. Pat. No. 4,310,417. Located intermediate opening 11 and intake end 12 is paddle wheel 30 shown in FIGS. 3 and 4 which is rotated clockwise to feed oily metal chips and chunks into said conduit 10.

Figure 2:
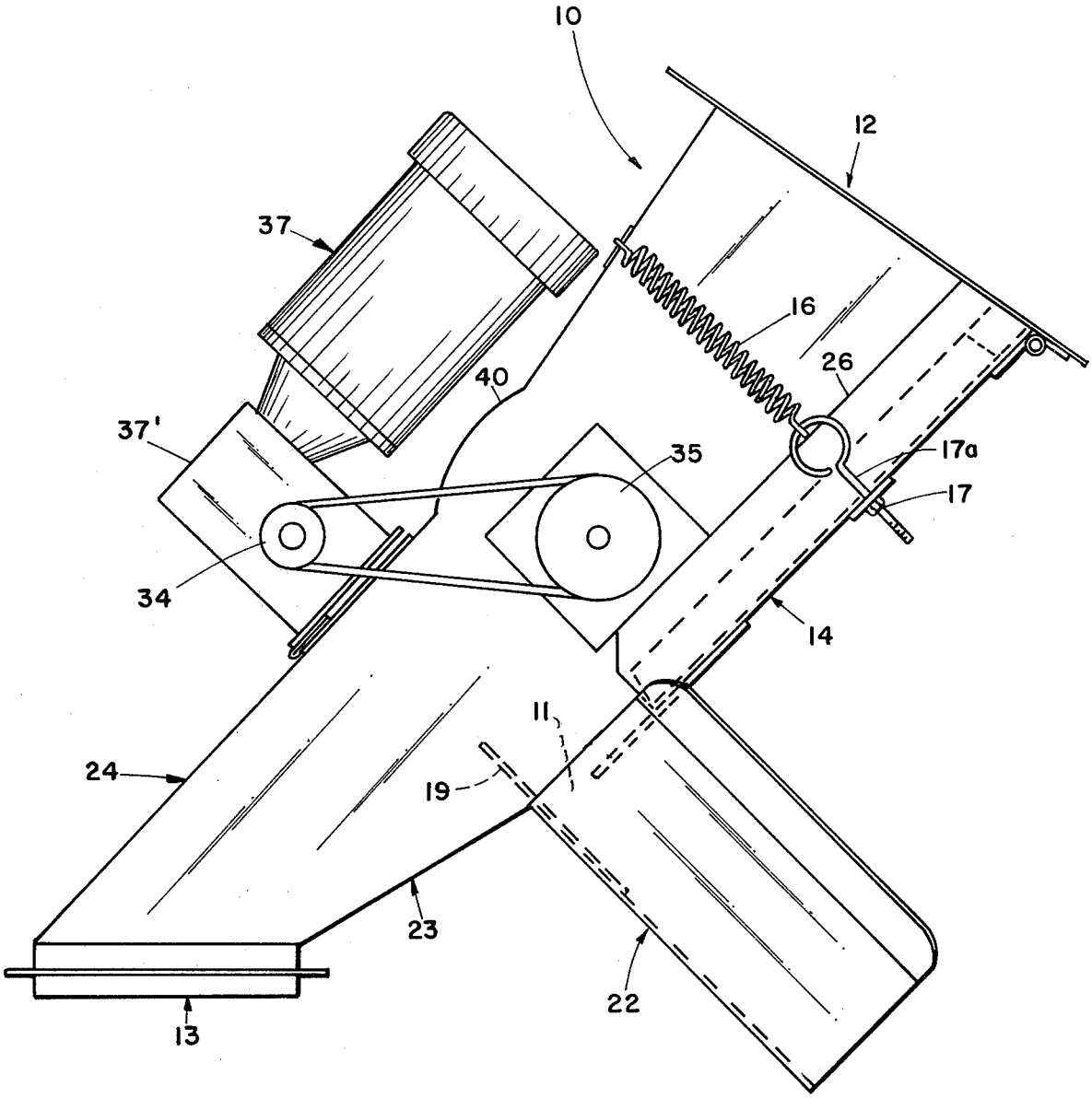
FIG. 2 is an enlarged side elevation view of the invention.

The paddle wheel 30 has a plurality of blades 31 attached to shaft 33 and driven by pulleys 34 and 35 and motor means 37 and gear reducing means 37' (FIG. 2). Circular flanges 36 are employed to reinforce the blades. Blades 31 can also be divided radially into inner blades 31*a* and outer blades 31*b* which are removably attached by fastener means 32. Thus, the outer blades of this design can easily be replaced as they wear out.

The bottom wall 23 of the conduit beneath the gate 30 has a hinged section 14. The hinged section 14 is pivotally attached to the intake end 12 of conduit 10 by means of hinge 15. However, it should be apparent that hinged section 14 can be hinged at various points between intake end 12 and paddle wheel 30.

The hinged section 14 extends beneath the paddle wheel 30 and forms the upstream end of the opening 11. The hinged section has upturned sides 26 which telescope over the outside of the conduit positively to confine the conduit's contents. To further assure positive sealing of the hinged section as it closes by eliminating interference from material in the conduit, the sides of the conduit are relieved at 27 from the hinge 15 to the upstream end of the opening 11. A baffle 20 is slidably secured to the hinged section at the opening 11. By means of the fastener 28, the position of the slide can be set to adjust the size of the throat of the opening 11 to provide the required air velocity for efficient classification and separation.

Preferably, the point of tangency between the paddle wheel 30 and the section 14 is closely adjacent the opening 11 and substantially spaced from the hinge 15. A pair of springs 16, one on each side of the conduit, are secured at 17 to the hinged section 14 intermediate the hinge 15 and the gate 30 (FIG. 2). The springs 16 bias the hinged section into closed position.

The conduit 10 should be dimensioned near said paddle wheel gate such that the distance between the top wall 24 of said conduit and the bottom wall 23 of said conduit is equal to the diameter of paddle wheel 30; the distance between side walls 25 should equal the width of paddle wheel gate 30. If dimensioned in this manner, the paddle wheel can form an effective barrier to the flow of air through the intake end as the paddle wheel gate rotates to meter the flow of metal chips into said conduit 10.

Preferably, the paddle wheel 30 is so designed that at least one paddle is always in contact with both the top of the conduit and with a layer of chips covering the bottom of the conduit. This is accomplished at the top of the paddle wheel by providing the arcuate segment 40 in top wall 24. This arcuate segment permits constant contact between the paddle wheel and the conduit, forming a continuous air flow seal. The ends of the paddle are designed to provide minimum clearance with the sides of the conduit. Practical minimum is that which will not cause a bind when a chip becomes wedged between the end of the paddle and the conduit side walls.

Figure 3:
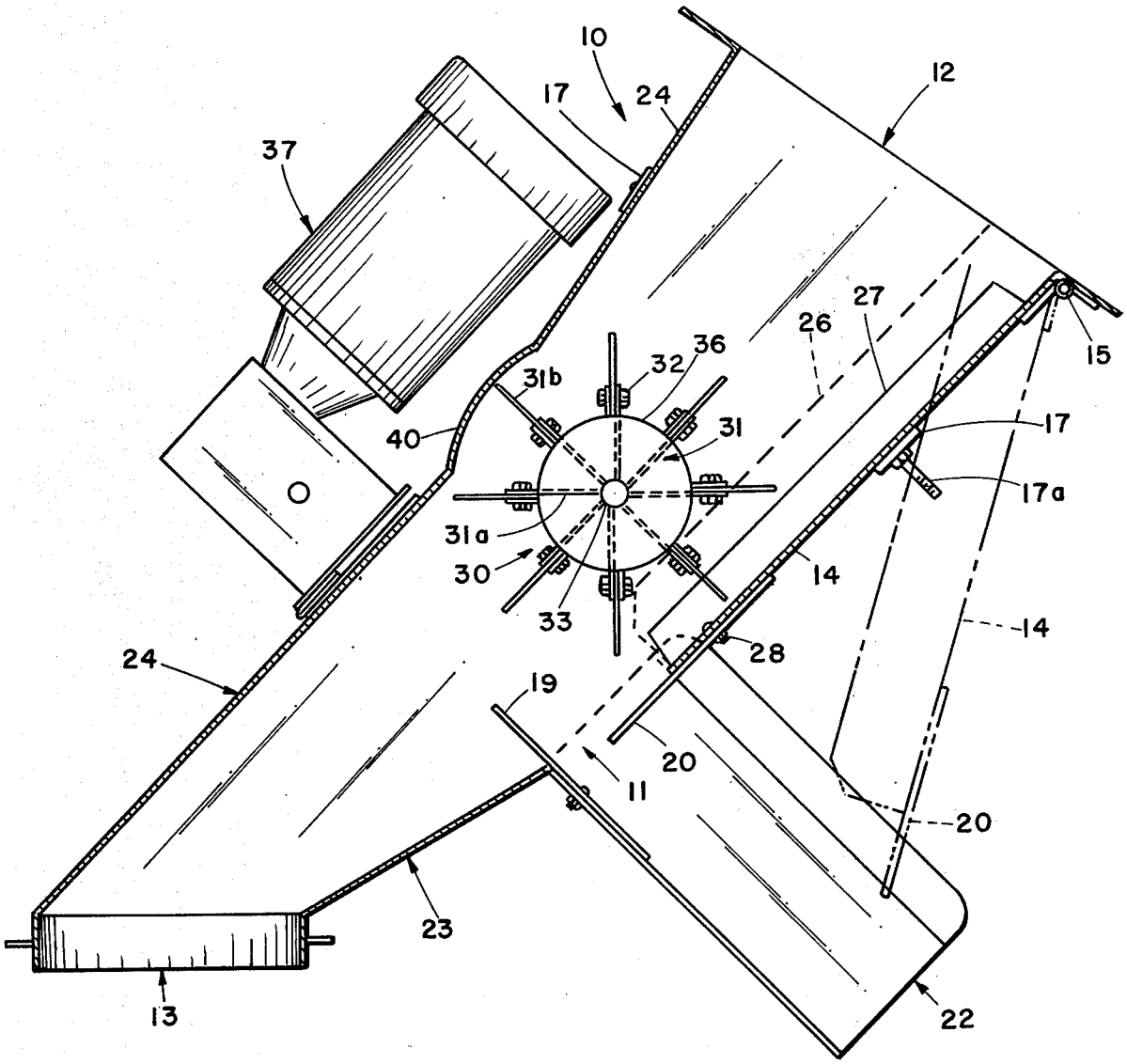
FIG. 3 is a sectional view taken on the line III—III of FIG. 4 showing in phantom the hinged section of the bottom wall of the conduit in the open position.
Figure 4:
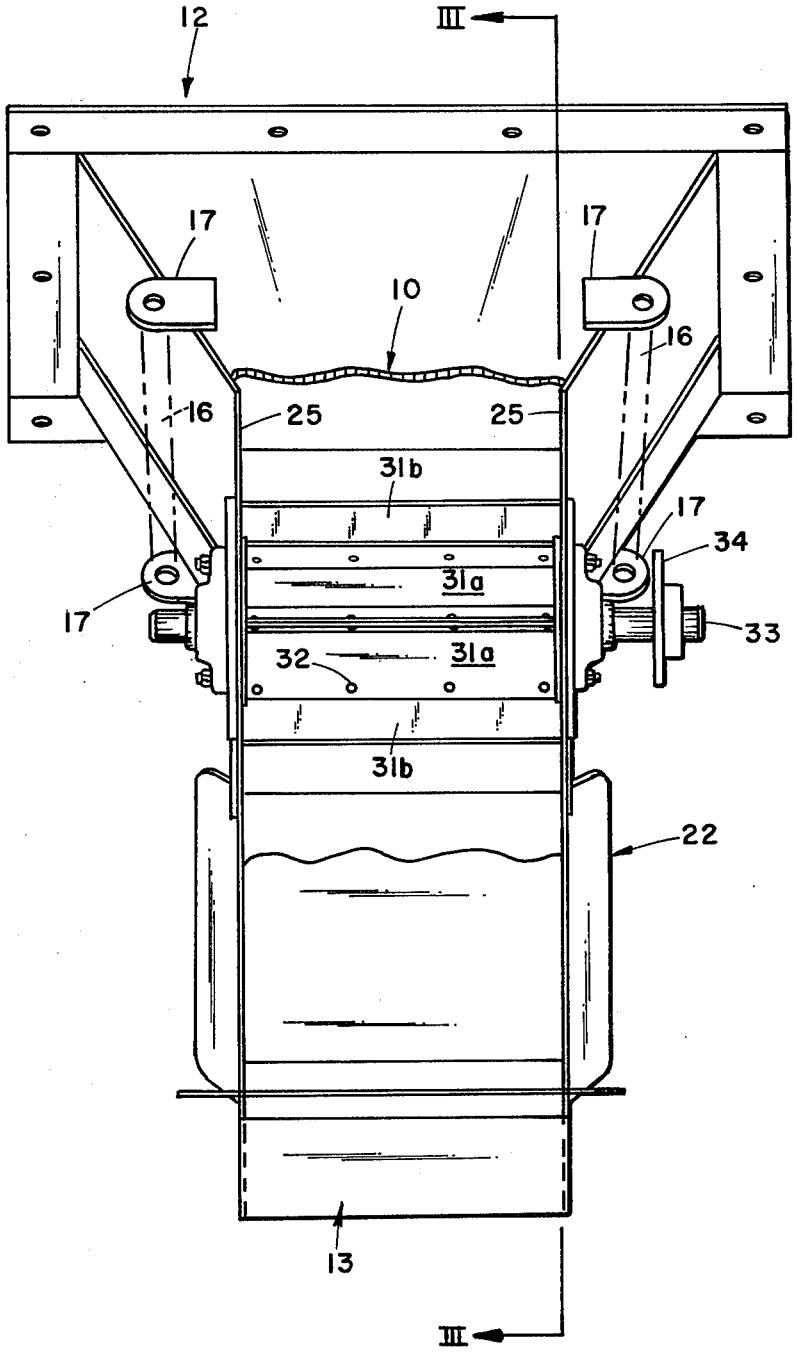
FIG. 4 is a partially broken top elevation view of the separator illustrating the paddle wheel gate which controls the feed to the separator.

Vertical baffle 19, shown in FIGS. 2 and 3, is provided at the downstream end of opening 11 to create a surface against which a large piece of metal will impact and be caused to lose sufficient momentum to fall through opening 11. Smaller pieces of metal may also impact baffle 19. However, these smaller pieces will be entrained in the air current flowing upwardly through opening 11 and be carried through the outlet end 13 of conduit 10 into centrifuge 45.

The operation of the apparatus will now be explained in detail. From various metal machining operations a stream of metal wastes coated with cutting oil and including chunks of metal and small fine pieces of metal is fed by feed means 50 into intake end 12 of conduit 10. Paddle wheel 30 rotated in a clockwise direction, as illustrated in FIG. 1, feeds the metal chips into the conduit 10. Typically the paddle wheel is operated at a speed ranging from 10 to 50 revolutions per minute. However, there is no critical rotation speed; in fact, rotation speeds outside this range can be used to achieve desired results.

Centrifuge 45 or other blower means generates a suction through outlet 13 which in turn generates high velocity air current through opening 11. As paddle wheel 30 is metering the flow of chips and the like into the conduit, the velocity of the air current entrains the chips and carries them airborne across the opening 11 and then into the centrifuge while permitting the large chunks to hit baffle 19 and fall through opening 11. The position of the baffle 20 is adjusted to increase or decrease the velocity of the air flowing through opening 11. The adjustment will be varied to entrain all of the metal chips except those of greater than a preselected size. Baffle 19 can be raised or lowered to control the classification of the particles by varying the minimum size of chunks which will be separated from the material at opening 11. Raising baffle 19 will cause a smaller piece of metal to fall through opening 11. Lowering baffle 19 results in an increase in the size of particles which will be separated from the air stream. Means to provide such adjustments to baffles 19 and 20 are obvious and well known in the prior art, and will not specifically be discussed herein. Chute 22 is provided to direct into receptacle 60 the chunks falling through opening 11.

To protect the paddle wheel from damage and prevent it from being stalled by particularly large or odd shaped chunks of metal becoming caught between a blade and the bottom wall, the hinged section 14 of bottom wall 23 is provided to effect a safety release. When the gate 30 attempts to pass a large chunk of metal, hinge section 14 is forced downwardly against springs 16. Springs 16 restore hinged section 14 to the closed position against gate 30 after the large chunk has discharged. Since the end of the hinged section is within the chute 22 the chunk will discharge into the chute, particularly since the downward pivoting of the section enlarges the throat and decreases the air velocity.

FIGS. 1 and 2 illustrate a coil spring 16 attached to eyelets 17. The tension exerted by the springs is adjusted by the nuts 17*a*. The tension on the springs should be adjusted such that the hinged section will remain closed at all times unless forced open by a large chunk being forcibly carried under the rotating gate.

Figure 10:
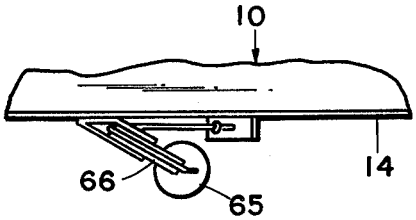
FIG. 10 is a fragmentary plan view of the gate biasing device of FIG. 9.
Figure 9:
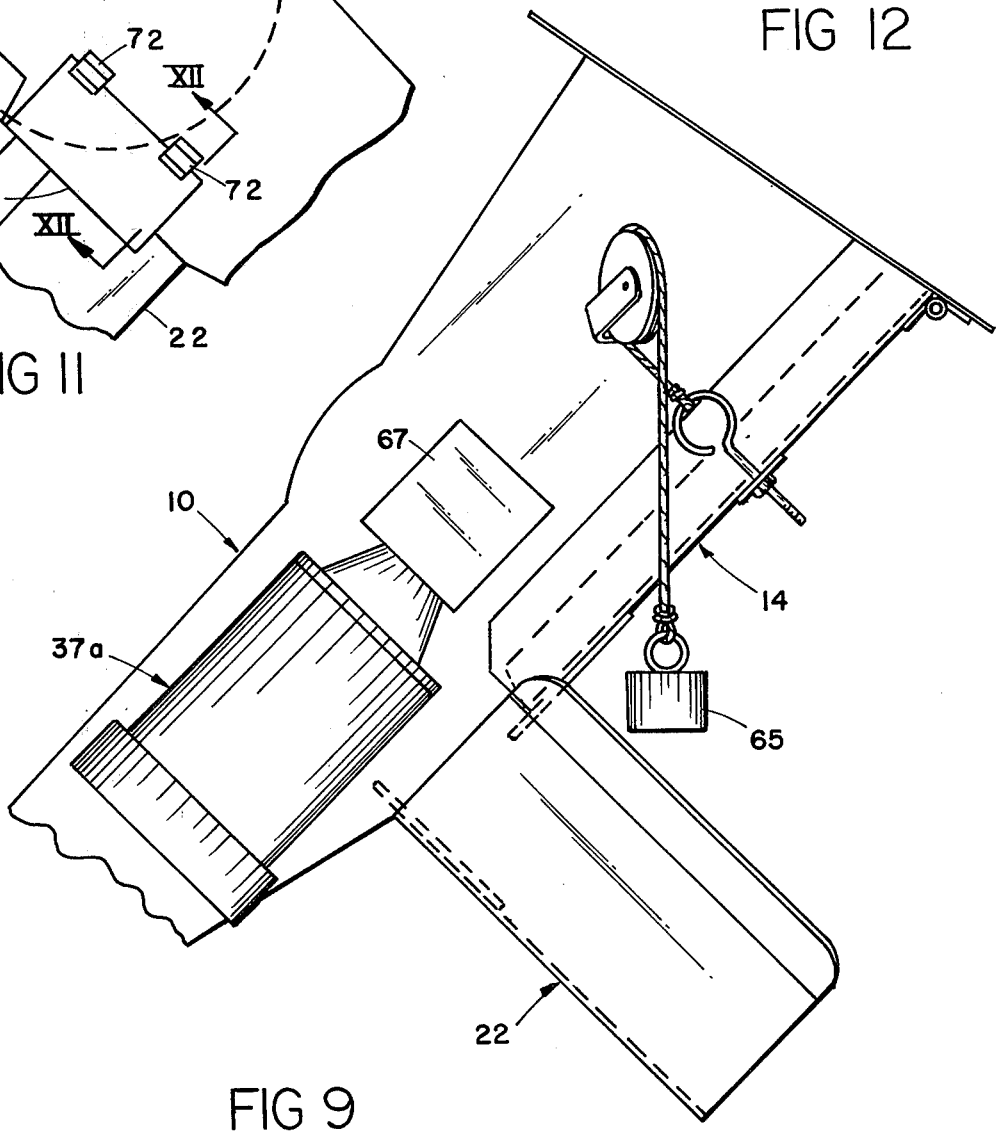
FIG. 9 is a fragmentary side elevation view of a further modification of the invention.

FIGS. 9 and 10 illustrate the use of weights 65 to bias the hinged section 14 into closed position. The weights, one on each side, are connected to the hinged section by a rope or chain passing over a pulley 66. The weights have the advantage over springs in that they maintain a uniform degree of bias at all times rather than a bias value which increases the further the hinged section is forced open.

FIG. 9 also illustrates a modified drive for the paddle wheel gate with the prime mover 37*a* mounted on the side of the conduit 10 connected to the gear reducer 67 mounted on the end of the paddle wheel shaft.

In the preferred embodiment of this invention, conduit 10 is positioned at approximately a 45 degree angle to the horizontal. Forty-five degrees is not a critical angle. Any angle between about 20 degrees and 50 degrees can normally be used, depending upon the sizes of the material to be moved through it and the viscosity of the oils coating the metal chips. While the preferred embodiment of this invention employs gravity to feed the material through the chute; it is possible to use a substantially horizontal chute with material movement down the chute assisted by vibration.

To increase the air seal efficiency and extend the life of the paddle wheel gate, the outer blade portions 31*b* are fabricated of a flexible material such as a medium durometer rubber or a reinforced material such as conveyor belting. When the outer blade portions are of a flexible material, no clearance need be maintained with the side walls since the blades will deflect to prevent any jamming of the mechanism.

Figure 5:
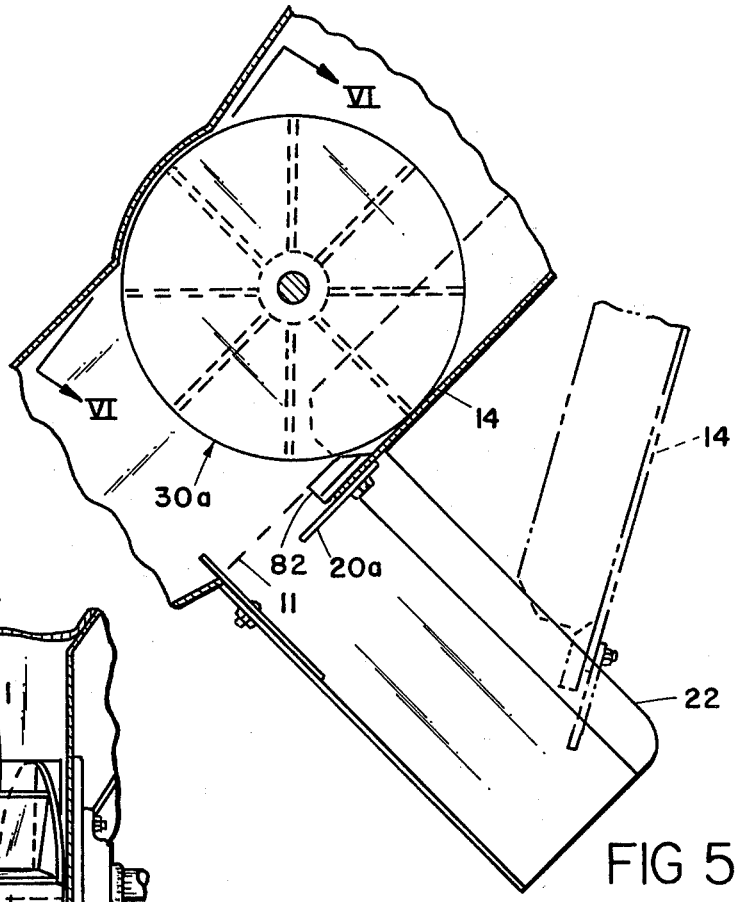
FIG. 5 is a fragmentary sectional view taken along the same plane as FIG. 3 illustrating a modified construction for the paddle wheel gate.
Figure 6:
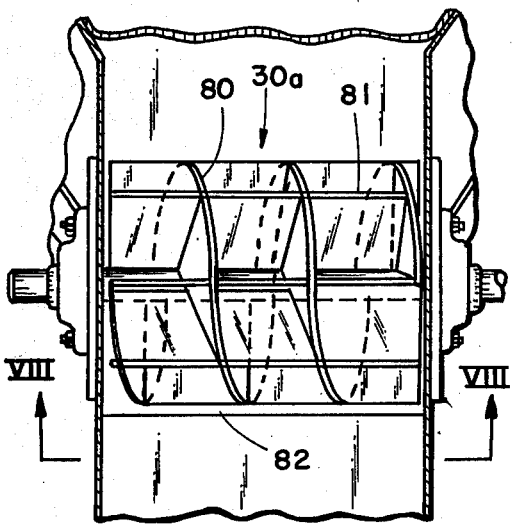
FIG. 6 is a sectional view taken along the plane VI—VI of FIG. 5.
Figure 8:
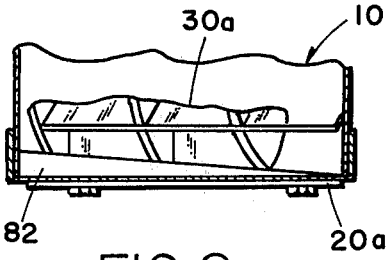
FIG. 8 is a fragmentary sectional view taken along the plane VIII—VIII of FIG. 7.
Figure 7:
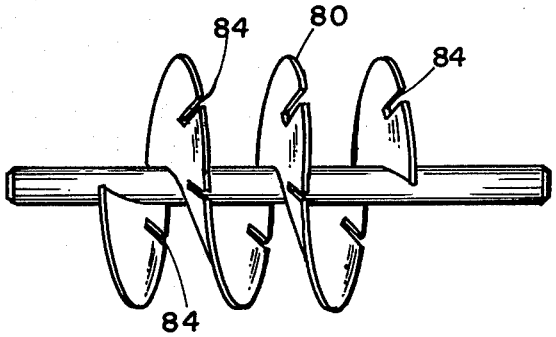
FIG. 7 is an elevation view of the helix used in the paddle wheel gate of FIGS. 5 and 6.

FIGS. 5–8 illustrate a further modification designed to handle long objects. It has been discovered that some long objects such as lengths of bar or rod may not be effectively discharged by the paddle wheel gate 30 of FIGS. 3 and 4 because the gate and gravity combine to push the long pieces across the opening 11. To overcome this, the paddle wheel 30*a* has been modified by making its basic structure a helix 80 (FIG. 7). Within the helix 80 a plurality of paddles 81 are provided which extend to the periphery of the helix. A tapered guide plate 82 is secured to the inside face of the end of the hinge section 14.

Preferably, the guide plate 82 is not only tapered transversely of the conduit but also tapered in the direction of material movement so its thicker end will not act as a stop (FIG. 5). This plate is immediately downstream of the paddle wheel gate 30*a* and its downward taper is in the direction in which material is pushed by the helix as when the helix is rotated in the direction of arrow A in FIG. 6. The combination of the helix 80, paddles 81 and the guide plate 82 progressively pivot a long item into an angular position extending diagonally across the conduit. In this position it cannot bridge the opening 11 and its discharge through the chute 22 into the receptacle is assured. An adjustable baffle 20*a* can be provided below the guide plate 82 since the two serve different and non-conflicting purposes.

The paddle sections 81 are preferably of metal and secured to the helix 80 by suitable means such as welding. However, they could also be fabricated of other material such as reinforced rubber. A preferred construction for the paddle wheel gate 30*a* is to provide a plurality of radial slits 83 in the helix 80 and seat the paddles 81 in the slits with each paddle being a rectangular plate extending the full length of the paddle wheel. While FIG. 6 illustrates the plates extending to the root of the helix, this is not necessary since they are duly needed at the outer radial portion of the paddle as suggested by the short radial slots 84 illustrated in FIG. 7.

Figure 11:
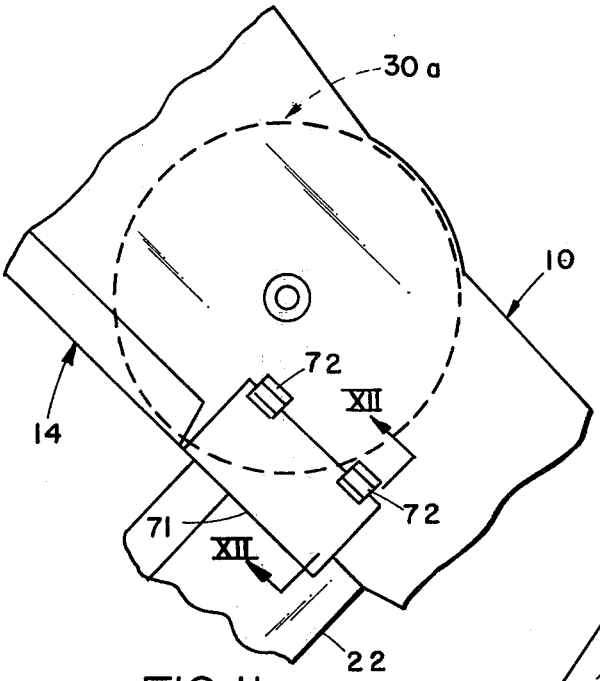
FIG. 11 is a fragmentary view of the side opposite from that of FIG. 9 illustrating a further modification of the invention.
Figure 12:
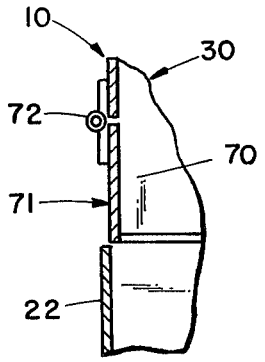
FIG. 12 is a fragmentary sectional view taken along the line XII—XII of FIG. 11.

FIGS. 11 and 12 illustrate a further modification designed to accommodate particularly long chucks such as bars or rods. Occasionally the scrap will include pieces of such length that when turned sideways to the conduit 10 they may wedge between the sides of the conduit. When this happens, not only is the operation of the equipment stopped, significant damage to the equipment may also occur.

To eliminate this problem, a relief opening 70 is provided in the side of the conduit opposite from the end of the helix 80 of the gate 30*a*. The opening is located downstream of the paddle wheel gate and provides a means whereby the end of the long chunk can temporarily project out of the conduit. The opening 70 is normally closed by a panel or door 71 pivotally mounted along its upper edge by hinges 72. The hinges 72 incorporate means to bias the door closed unless forcibly caused to open. Such hinges have long been used for various purposes such as closing screen doors and the like.

In view of the foregoing, it is apparent that the present invention provides an effective means for separating large or oversize metal chunks from a stream of metal chips and cutting oil under a wide range of operating conditions. The invention provides an accurate and dependable means of classification through a wide range of conditions. Thus, the cutting oil laden metal chip stream can safely be introduced into a centrifuge. The machine can be adjusted as needed as the character of the chip stream varies from time to time.

Of course, it is understood that the above is merely a preferred embodiment of the invention and that various changes and alterations may be made without departing from the spirit and broader aspects of the invention. Such are to be considered as included in the hereinafter appended claims unless the claims by their language expressly state otherwise.

The embodiments of the invention in which an exclusive property or privilege is claimed are defined as follows:

1. Apparatus for separating large metallic pieces from an oil coated mixture of the metallic waste products of machining operations, said apparatus including a conduit having receiving and discharge ends and a bottom wall, an opening through said bottom wall intermediate said ends, a paddle wheel-type rotary metering element mounted in said conduit adjacent to and upstream of said opening for metering the movement of waste products through said conduit and providing an air seal between said receiving end and said opening, means for effecting rotation of said element, means for generating an air current through said opening such that the velocity of said air current is sufficient to entrain small metallic particles while permitting large metallic pieces to fall through said opening, said apparatus characterized in that said bottom wall beneath said element has a movable section and means pivotally securing said section to said conduit between said element and said receiving end; means resiliently biasing said section into closed position whereby said section may be forced to pivot away from said metering element by a large metallic piece entering between said element and section.

2. The apparatus of claim 1 wherein said movable section comprises a hinged section of said bottom wall with hinge means attaching said section to the receiving end of said conduit.

3. The apparatus of claim 2 wherein said movable section includes an adjustable baffle extending into said opening to vary the velocity of the air current through said opening.

4. The apparatus of claim 1 wherein said paddle wheel-type rotary metering element has a diameter equal to the distance between the top and bottom walls of said conduit and comprises a plurality of radially projecting blades of sufficient width to maintain continuous contact with said side walls of said conduit and of sufficient number so as to maintain virtually continuous contact with said top and bottom walls of said conduit such that said air seal is provided between said receiving end and said opening.

5. The apparatus of claim 4 wherein said blades of said paddle wheel are radially divided into an inner blade portion and an outer blade portion detachably secured to said inner blade portion.

6. The apparatus of claim 5 wherein said outer blade portion is made from a flexible material.

7. The apparatus of claim 1 wherein said metering element also has a helical member extending the length of said element for pivoting elongated pieces into an angular position with respect to the lengthwise axis of said conduit.

8. The apparatus of claim 7 wherein a wedge-shaped guide plate is provided in said conduit between the metering element and said opening, said guide plate being tapered downwardly in the direction of lateral movement of material being pushed by the helical member when the element is rotated.

9. The apparatus of claim 7 wherein said helical member extends radially to and defines the circumference of said element.

10. The apparatus of claim 1 wherein the means for providing an air current through said opening, comprises: an oil separating centrifuge attached to said discharge end of said conduit, said centrifuge having means for generating a sub-atmospheric condition in the conduit.

11. The apparatus described in claim 10 further characterized in that the element includes a helical member extending the length of said element for pivoting elongated pieces into an angular position with respect to the lengthwise axis of said conduit.

12. The apparatus described in claim 11 further characterized in that an opening is provided in the side of said conduit adjacent to and downstream of said metering element; said opening being on the side of said conduit opposite from the direction in which said helical member urges the scrap; a closure for closing said opening and means biasing said opening into closed position.

13. The apparatus described in claim 11 further characterized in that a wedge-shaped guide plate is provided in said conduit between the metering element and said opening, said guide plate being tapered downwardly in the direction of lateral movement of material being pushed by the helical member when the element is rotated.

14. The apparatus described in claim 13 further characterized in that said guide plate is also tapered downwardly toward said element to guide material to slide up over it.

15. An apparatus for separating large metallic pieces from machining waste material being fed to a lubricant extractor, said means having an inclined conduit with an air inlet and piece discharge opening intermediate its ends; said lubricant extractor having air pump means for creating an air flow demand from said conduit of a magnitude sufficient to entrain and transport across said opening all metallic portions of the waste except large pieces, said apparatus characterized by a driven paddle wheel metering element rotatably mounted in said conduit adjacent to and upstream of said opening, said element being of a size for substantially closing said conduit; said element having a plurality of transversely extending paddle plates for forcibly moving material past said element at a controlled flow rate; the bottom wall of said conduit at said element being movably mounted for movement toward and away from said element.

16. The apparatus described in claim 15 further characterized in that said helical member extends radially to and defines the circumference of said element.

17. A process for separating large metallic pieces from an oil coated mixture of the metallic waste products of machining operations, comprising: feeding said waste products into a conduit having a receiving end for receiving said waste products before separation, a discharge end for discharging said waste products after separation, and a bottom wall with an opening therein intermediate said ends; said waste product separating process including providing a rotary metering and air seal through said conduit by means of a paddle wheel-type rotary metering element mounted in said conduit adjacent to and upstream of said opening; generating an inwardly moving air current through said opening of sufficient velocity to entrain small metallic particles while permitting large metallic pieces to fall through said opening; providing an air seal between said opening and said receiving end; and providing a pivotally movable segment in said bottom wall beneath said element, which is urging said segment against said element, said movable segment pivoting away from said metering element when a large metallic piece enters between said element and segment.

18. The process described in claim 17 further characterized in that elongated pieces of scrap are pivoted by the element toward alignment with the axis of the conduit.

* * * * *